US011952157B2

(12) United States Patent
Gerri

(10) Patent No.: US 11,952,157 B2
(45) Date of Patent: Apr. 9, 2024

(54) PACKAGING MACHINE FOR PACKAGING PAPER ROLLS

(71) Applicant: PLUSLINE S.R.L., Bologna (IT)

(72) Inventor: Vittorio Gerri, Bologna (IT)

(73) Assignee: PLUSLINE S.R.L., Bologna (IT)

( * ) Notice: Subject to any disclaimer, the term of this patent is extended or adjusted under 35 U.S.C. 154(b) by 245 days.

(21) Appl. No.: 17/616,594

(22) PCT Filed: May 18, 2020

(86) PCT No.: PCT/IT2020/050123

§ 371 (c)(1),
(2) Date: Dec. 3, 2021

(87) PCT Pub. No.: WO2020/245853

PCT Pub. Date: Dec. 10, 2020

(65) Prior Publication Data

US 2022/0227515 A1 Jul. 21, 2022

(30) Foreign Application Priority Data

Jun. 4, 2019 (IT) ..... 102019000008031

(51) Int. Cl.

| | |
|---|---|
| ***B65B 11/04*** | (2006.01) |
| ***B65B 11/00*** | (2006.01) |
| ***B65B 11/20*** | (2006.01) |
| ***B65B 25/14*** | (2006.01) |
| ***B65B 49/08*** | (2006.01) |

(Continued)

(52) U.S. Cl.

CPC ..... *B65B 49/08* (2013.01); *B65B 11/004* (2013.01); *B65B 11/20* (2013.01); *B65B 25/146* (2013.01); *B65B 49/14* (2013.01); *B65B 51/14* (2013.01)

(58) Field of Classification Search

USPC ..... 53/209

See application file for complete search history.

(56) References Cited

U.S. PATENT DOCUMENTS

| | | | | |
|---|---|---|---|---|
| 2005/0060954 | A1* | 3/2005 | Dall'Omo | B65B 11/24 53/370 |
| 2005/0229546 | A1* | 10/2005 | Poli | B65B 51/14 53/228 |
| 2020/0391893 | A1* | 12/2020 | Rasi | B65B 11/22 |

FOREIGN PATENT DOCUMENTS

| | | | |
|---|---|---|---|
| EP | 2743192 | A1 | 6/2014 |
| IT | 201700035972 | A1 | 10/2018 |
| WO | 2019097378 | A1 | 5/2019 |

OTHER PUBLICATIONS

International Search Report dated Nov. 5, 2020 in corresponding application PCT/IT2020/050123, 3 pages.

* cited by examiner

*Primary Examiner* — Chinyere J Rushing-Tucker
(74) *Attorney, Agent, or Firm* — Maier & Maier, PLLC

(57) ABSTRACT

Packaging machine for packaging paper rolls, including an operating group forming packages, with an entrance station for the rolls and the packaging sheets, and an output station for the packaged rolls; an elevator; a structure on which the operating group is mounted; a plane on which a folder and a counter-folder are formed for folding the packaging sheets under the rolls; a conveyor for moving the packages being formed above said plane; means for welding the packaging sheets; a welding bar for welding the packaging sheets under the rolls. The welding bar is configured to come out through an opening made on the counter-folder and reposition itself below the latter. The carriages are controlled independently of each other.

6 Claims, 8 Drawing Sheets

(51) Int. Cl.
*B65B 49/14* (2006.01)
*B65B 51/14* (2006.01)

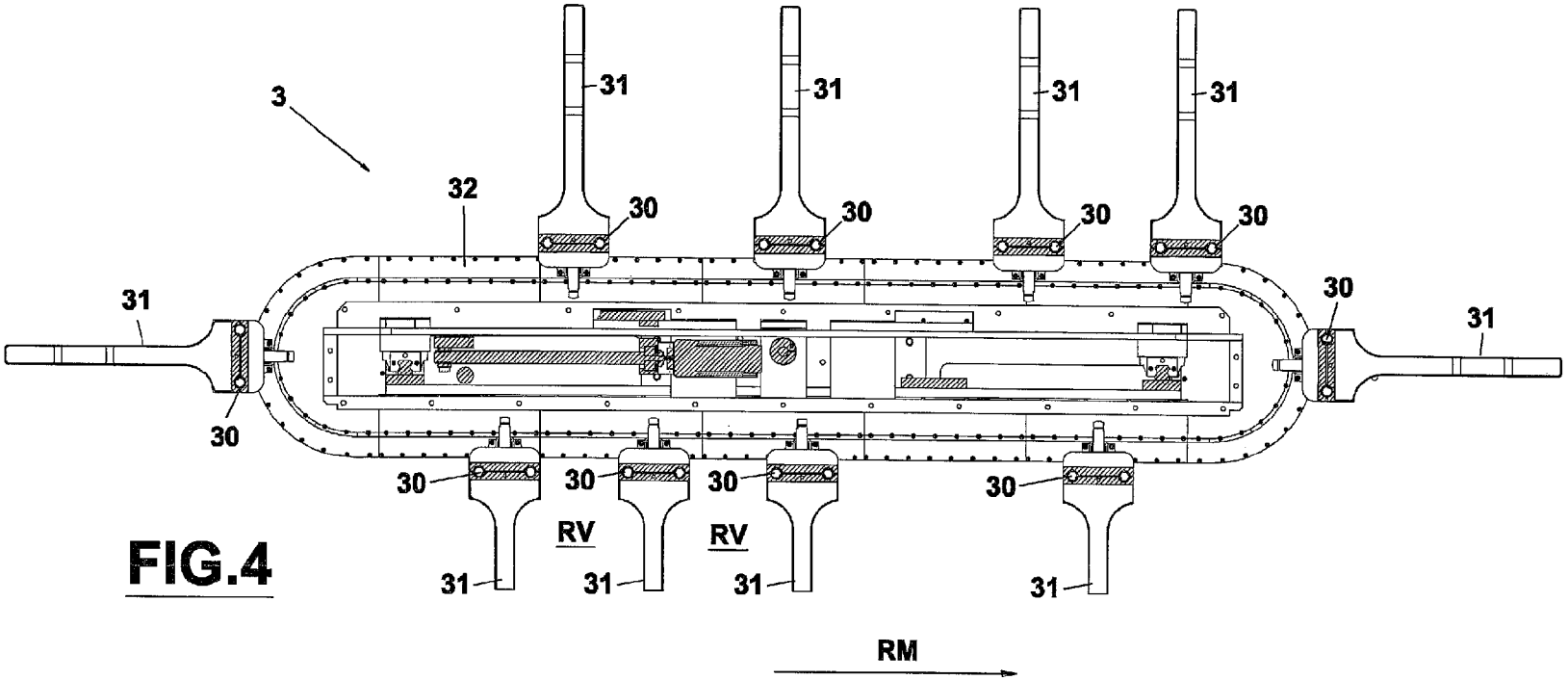
31
30
31
30
31
30

PACKAGING MACHINE FOR PACKAGING PAPER ROLLS

FIELD

The present invention relates to a packaging machine for packaging paper rolls.

BACKGROUND

U.S. Pat. No. 6,067,780 describes an automatic machine for packaging products such as paper rolls, using a sheet of packaging material which is wrapped and folded around the product and sealed on itself.

In the packaging machines of the type mentioned above, the packaging is carried out by sequentially feeding the individual products or groups of products along a forming line on which the products advance passing through a series of operating stations in each of which specific operations are carried out which as a whole determine the desired packaging. In general, in the various stations of an automatic machine for packaging products such as paper rolls, the following operating phases are carried out: the entry into the machine of products surmounted by a sheet of packaging material, in particular a plastic film; wrapping the sheet of packaging material around the products and overlapping the opposite edges of said material under the products; the formation on said sheet of packaging material of a predetermined number of closing flaps of the package; folding and sealing the said flaps to close the package thus obtained. In practice, the rolls of paper are held together by a wrapping consisting of the film of plastic material (for example, polypropylene or polyethylene) wrapped around the rolls of paper and subsequently folded and sealed to form the final package. From a structural point of view, the packaging machines of the type mentioned above have a rolls entry station in which an elevator is arranged which transfers the same rolls from an entry level to a higher level where the members intended for the realization of the very packings are located. These members generally comprise a mechanism for moving the rolls along a predetermined direction of treatment, a mechanism for folding the packaging sheet and a mechanism for welding the sheet itself which, together, form a group for forming the packages that in technical jargon it is known as "upper puller".

SUMMARY

The present invention relates, in particular, to a packaging system in which, for the same production compared to traditional machines, the speed of formation of the individual packs being formed can be reduced, with the advantage of inducing minor mechanical stresses on the products to be treated and to be able to weld the lower edge of the packaging in a longer time, so as to be able to reduce the sealing pressure and/or the sealing temperature, energy consumption, wear of the sealing elements and deformations of the sealing elements themselves and the surrounding areas induced by the welding temperature; or, for the same treatment conditions for the products treated, it is possible to increase production, i.e. the number of completed packs in the unit of time. Further advantages derive from the increased operational safety and reliability of the packaging process carried out by a machine in accordance with the present invention.

This result has been achieved, in accordance with the present invention, by adopting the idea of making a machine having the characteristics indicated in claim 1. Other features of the present invention are the subject of the dependent claims.

BRIEF DESCRIPTION OF THE DRAWINGS

The aforementioned advantages and characteristics of the present invention will be more and better understood by each person skilled in the art thanks to the description that follows and the annexed drawings, provided by way of example but not to be considered in a limiting sense, in which:

FIG. 4 is a detail concerning the carriages for moving the rolls in the packages forming unit;

DETAILED DESCRIPTION OF THE EMBODIMENTS

Reduced to its essential structure and with reference to the figures of the attached drawings, a machine (M) in accordance with the invention includes:

- an operating group (PG) configured to obtain the formation of the packages, with a station (E) for the entry of the rolls (R) to be packaged and a station (U) for the exit of the packaged rolls;
- an elevator (1) arranged below said entrance station (E);
- a metal structure (2) on which said operating group (PG) is mounted.

Figure 1:
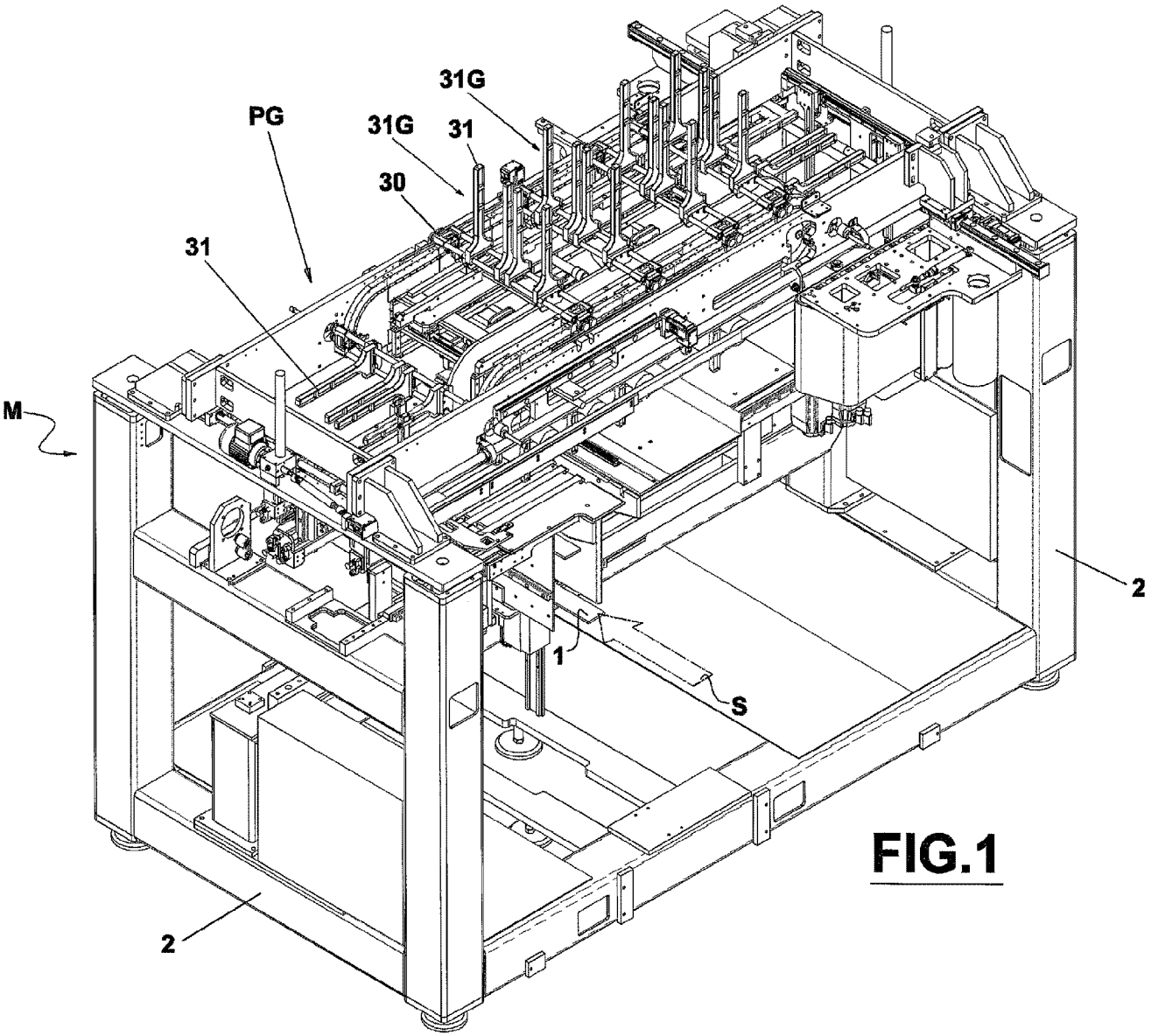
FIG. 1 is a schematic perspective view of a machine according to the present invention.
Figure 2:
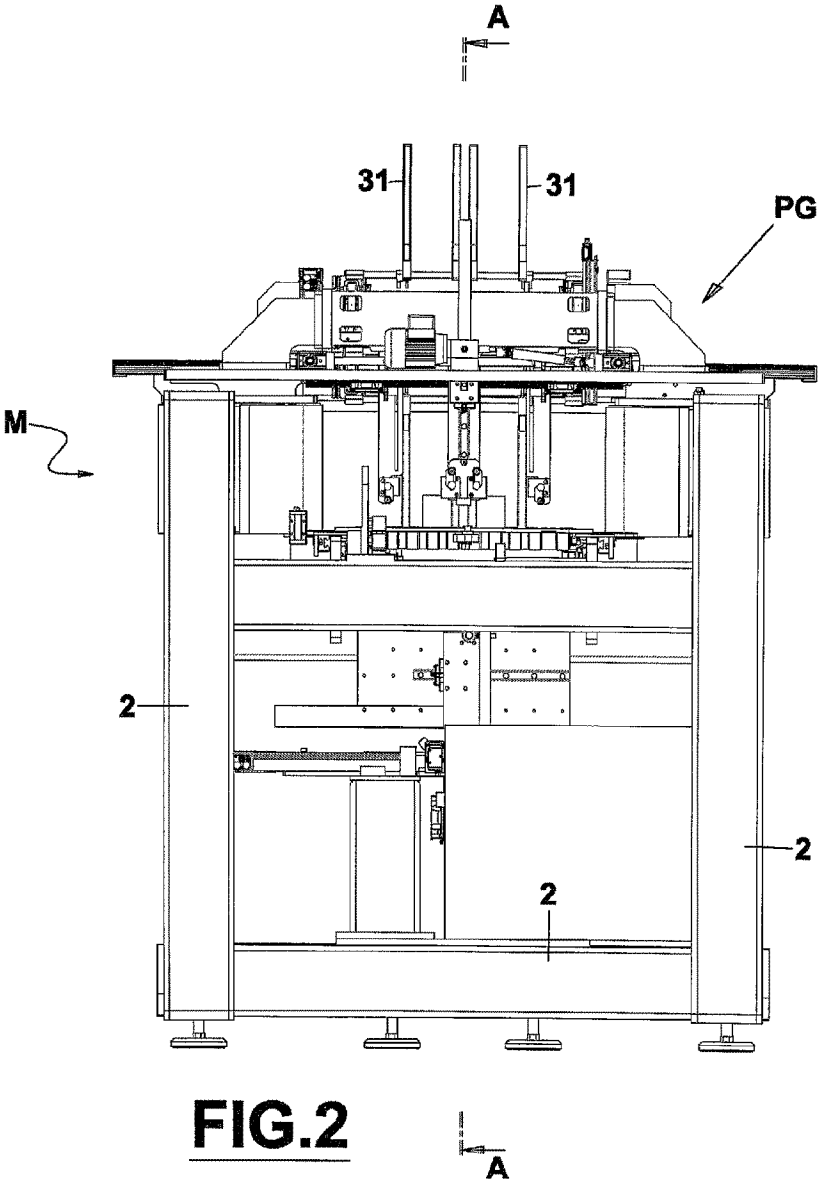
FIG. 2 is a side view of the machine shown in FIG. 1.

The rolls (R) reach the elevator (1) by means of a feeding system (not shown) known per se and therefore not described in greater detail. In FIG. 1 the arrow "S" indicates the direction of origin of the rolls to be packed that reach the elevator (1).

The elevator (1) operates the transferring of the rolls (R) from the arrival level to a higher level of the machine (M) where the operating group (PG) is located. The operation and structure of the elevator (1) are known to those skilled in the art. However, further indications relating to this component of the machine (M) are provided below.

The operating group (PG) located above the elevator (1) comprises a conveyor (3), commonly called the "upper puller", developed along a direction (RM) of movement of the rolls (R), i.e. of the packages, inside the same group. The conveyor or "upper puller" (3) is used to move the rolls (R) along said direction of movement of the packages (RM) between the entry station (E) and the exit station (U) from which the packaged rolls exit. In the example shown in the attached drawings, the packages are made up of a layer consisting of two rows of rolls (R) placed side by side. It is understood, however, that the machine can be programmed to produce packages containing rolls arranged differently than illustrated in the drawings. For example, the packages may consist of two or three overlapping layers of rolls placed side by side in each layer.

The entrance station (E) of the group (PG) is delimited laterally by two vertical surfaces (EV) which are spaced from each other by a predetermined value by other two underlying vertical walls (1V) which delimit the elevator laterally (1). The space (SV) between said walls (EV, 1V) is crossed by the packaging sheets used to make the packages.

Figure 3A:
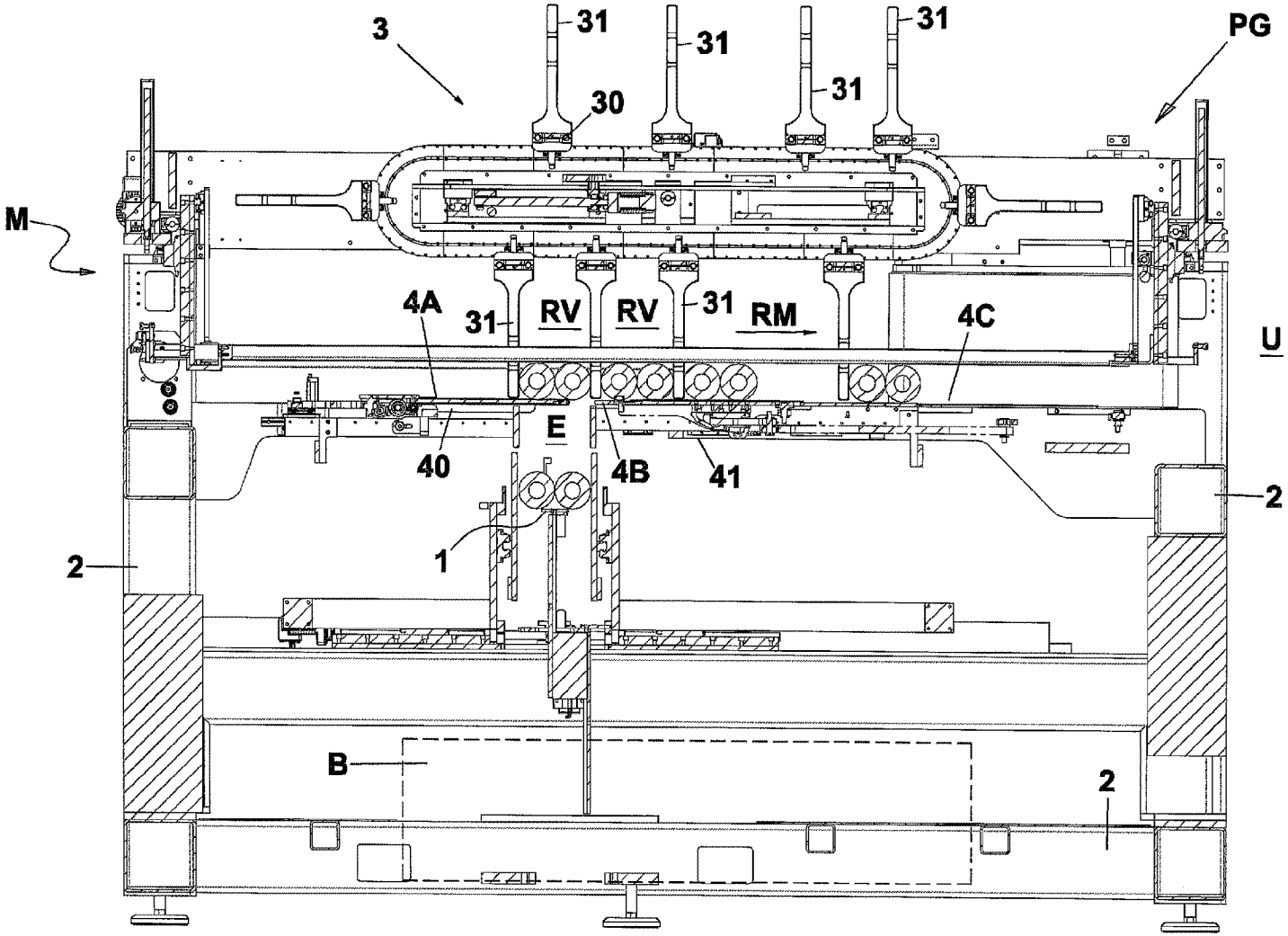
FIG. 3A is a section view along line A-A of FIG. 2.
Figure 3B:
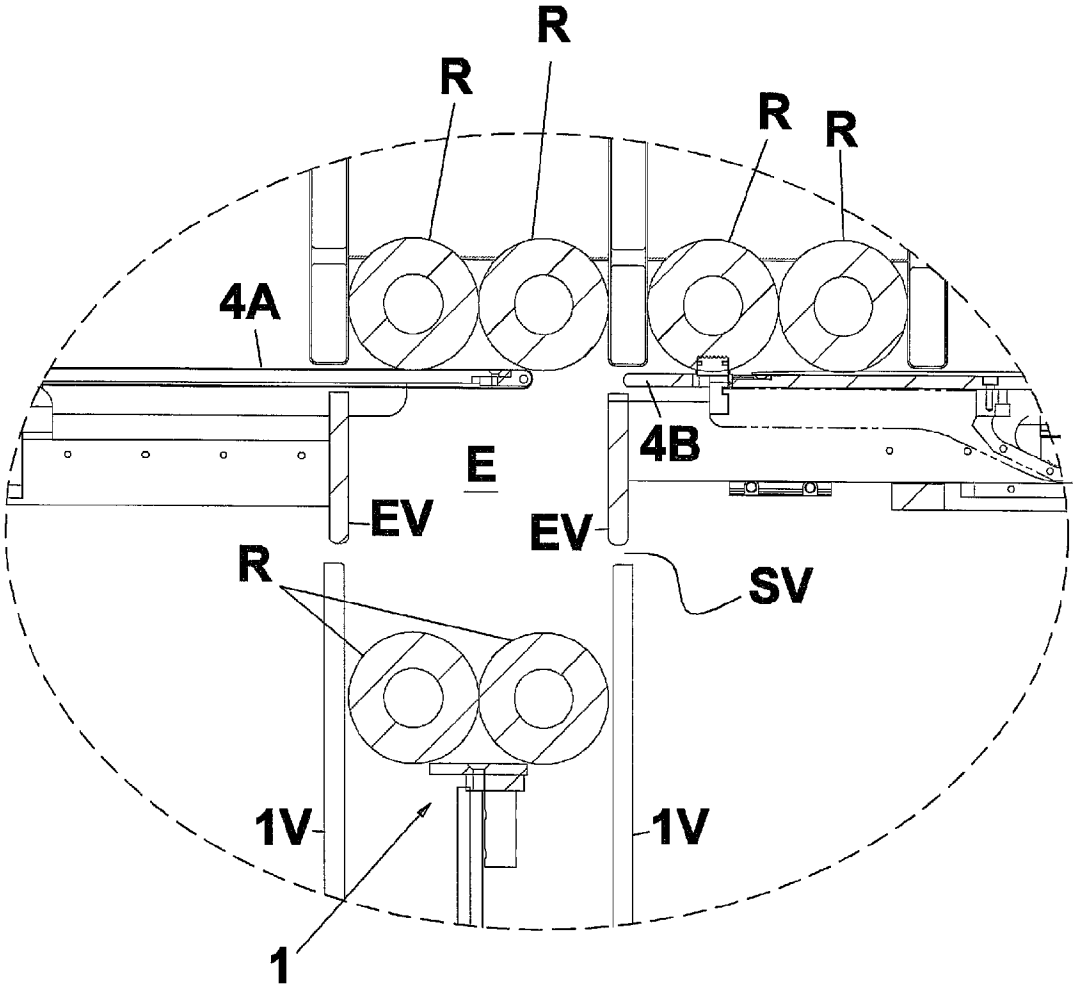
FIG. 3B is an enlarged detail of FIG. 3A.

The packaging sheet is fed between said entrance station (E) and the elevator (1). In FIG. 3A it is schematically represented a reel (B) from which, with methods known to those skilled in the art, is obtained the packaging sheet which consists of a film of heat-sealable plastic material cut to a predetermined length according to the package to be made. The packaging sheet passes through the space (SV) between the walls (EV, 1V), having to be intercepted by the rolls placed on the elevator (1) as further described in the following.

On its lower side, the operating group (PG) is delimited by a substantially horizontal plane (4A, 4B, 4C) which constitutes a lower support and sliding surface for the packages moved by the conveyor (3). Said plane (4A, 4B, 4C) comprises a first mobile part (4A, 4B) and a second fixed part (4C). The first part (4A, 4B) consists of two surfaces cooperating with each other to achieve the opening and closing of the entrance section (E) for the rolls to be packed and to fold the sheet under the rolls as further disclosed in the following. A surface (4A) is mounted on a respective carriage (40) operated by a corresponding actuator (not visible in the drawings) which moves the carriage itself, and therefore the surface (4A), to and from a second surface (4B) that, in turn, it is mounted on a carriage (41) controlled by an actuator (not visible in the drawings) which moves it to and from the first surface (4A). The surfaces (4A, 4B) of the plane (4A, 4B, 4C) are mobile surfaces while the part (4C) is a fixed surface downstream of the first two with respect to the direction (RM) of movement of the packs in the operating group (PG). The movable part (4A, 4B) of said plane constitutes a lower folding device for the packaging sheet and the movement of the surfaces that compose it is appropriately synchronized with the elevator (1). In accordance with the terminology commonly adopted in this sector of the art, in the continuation of the present description, the mobile surface (4A) will be called the "folder" while the mobile surface (4B) will be called the "counter-folder". Heating means are mounted on the counter-folder (4B) to provide the sealing of the edges of the packaging sheet under the rolls (R). In the following, a possible embodiment of the said heating means is described. With reference to the example shown in the annexed drawings, the conveyor (3) comprises a plurality of carriages (31G) each of which consists of a plate (30), mounted on two annular tracks (32), and a row of blades or "teeth" (31) protruding perpendicularly from the plate (30). The annular tracks (32) are parallel to each other and oriented orthogonally with respect to the plane (4A, 4B, 4C). The teeth (31) are therefore aligned transversely with respect to the direction (RM) of movement of the packages, i.e. of the rolls (R), in the operating group (PG). The annular tracks (42) are annular tracks with linear motor drive (for example of the type commercially available with the trade name Beckhoff XTS series) which, through the plates (30), move each carriage (31G) independently of the other carriages along an annular path that always has a lower section passing above the plane (4A, 4B, 4C) and directed in accordance with the direction of movement of the packs (RM) and an upper section along which the carriages (31G) move in the opposite direction. Two adjacent carriages (31G) form a compartment (RV) for receiving the rolls (R) of a package to be made, with a rear pushing carriage and a front containment carriage. Each compartment (RV) has a height compatible with the maximum number of overlapping layers of rolls of the packages to be made. The depth of the compartments (RV) is compatible with the maximum number of rolls to be aligned along a row of each pack. The width, i.e. the distance between two adjacent carriages (31G), varies according to the size of the package along the direction (RM), i.e. according to the number of rows of rolls of the package. It is understood that the upper puller can be made in any other suitable way.

In accordance with an operating scheme known per se to those skilled in the art, when the elevator (1) brings the received rolls (R) into the group (PG), by lifting them through the opened station (E), the packaging sheet is dragged upwards by the same rolls (R) and, thanks to the presence of the aforementioned vertical walls (EV, 1V), it wraps the rolls on their upper side and laterally. In this phase, above the station (E) there are two carriages (31G) that form a compartment (RV) in which the rolls (R) and the upper flap and the lateral flaps of the packaging sheet are inserted. At the end of this phase, the side edges of the packaging sheet protrude below the rolls (R). At this point, the station (E) is closed, moving the folder (4A) and the counter-folder (4B), and at the same time the carriages (31G) are moved in the direction of movement of the packages (RM). In this way, it is obtained the folding of the protruding edges of the packaging sheet under the rolls (R), i.e. the lower folding of the packaging sheet, and the translation of the packaging, not yet completed, in the direction of movement of the packages (RM) towards the fixed part (4C) of the plane (4A, 4B, 4C). Meanwhile, while the elevator is brought back to its starting level to receive other rolls intended for packaging, the edges of the packaging sheet previously folded under the rolls (R) are welded.

Between the entry station (E) and the exit station (U) of the group (PG), means, per se known, are arranged for folding the edges of the packaging sheet in correspondence of the head portions of the packages.

In accordance with a possible embodiment of the present invention, the carriages (31G) are controlled in such a way that two adjacent compartments (RV) are formed by the teeth (31) of three carriages (31G), with the teeth of the intermediate carriage that act as containment teeth for the compartment upstream and also as pushing teeth for the compartment downstream with respect to the aforementioned direction of movement of the packages (RM). In other words, the row of teeth (31) of the intermediate carriage of the triad acts as a front containment element for the rolls accommodated in the upstream compartment (compartment on the left in the drawings) and as a pushing element for the rolls accommodated in the downstream compartment (compartment on the right in the drawings). Consequently, the most advanced containment carriage in the direction of movement of the packages (RM) can be immediately spaced from the package being formed, at the end of the welding phase of the lower edges of the packaging sheet, while the carriage that follows it continues to exert on the same pack the thrust that determines its movement on the fixed part (4C) of the plane (4A, 4B, 4C) towards the exit (U). Each carriage (31G) comprises a single row of teeth (31), so that two adjacent compartments (RV) occupy less space along the direction of movement of the packages (RM) compared to traditional machines in which the carriages are formed by, or comprise, two parallel rows of teeth. Since the carriages (31G) are controlled independently from each other, each carriage (31G), and consequently each row of teeth (31), can be moved by the desired amount along the path defined by the annular tracks (32) independently of the others carriages (31G).

Figure 5:
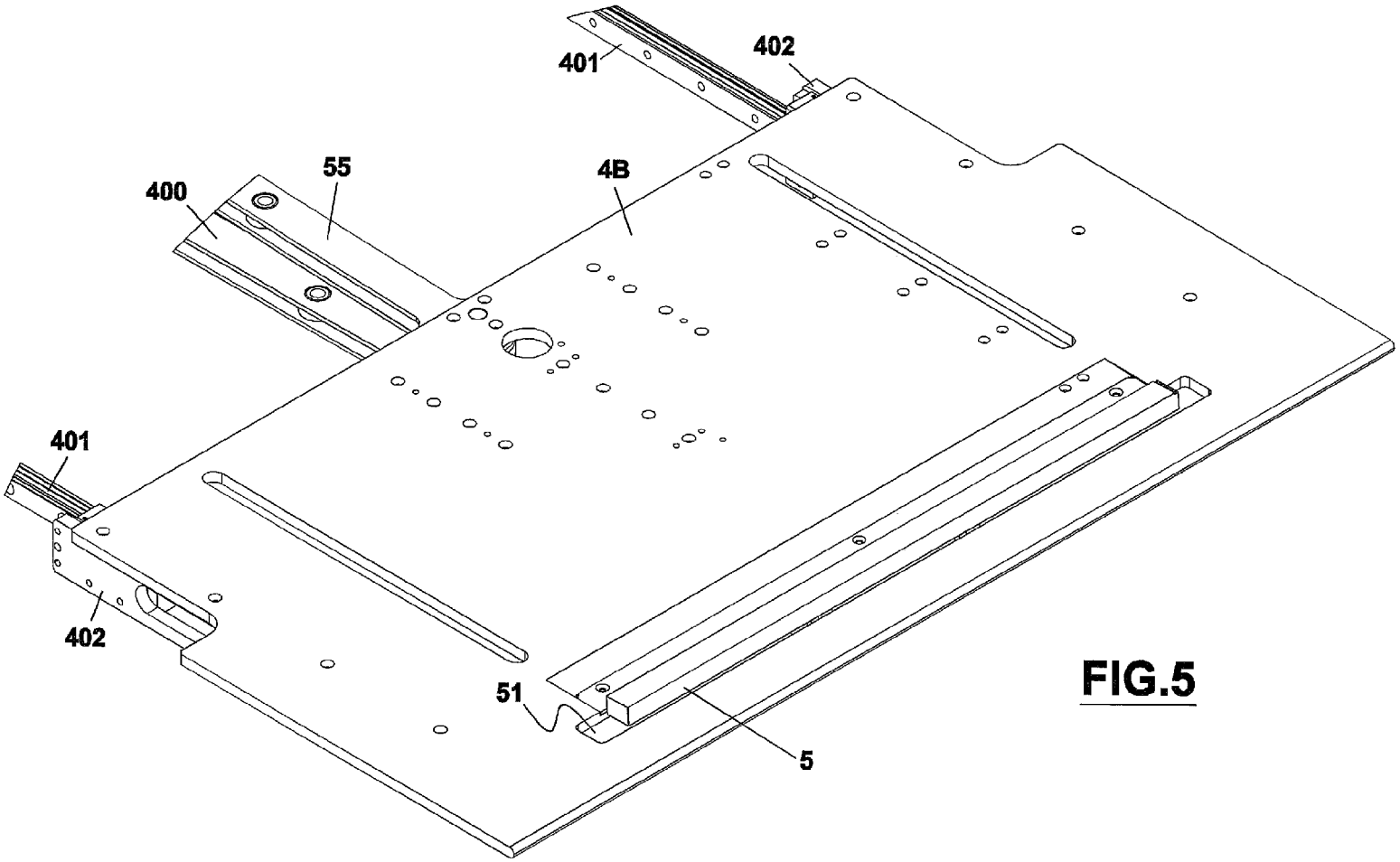
FIGS. 5 show the counter-folder with the welding bar and the respective driving group.
Figure 6:
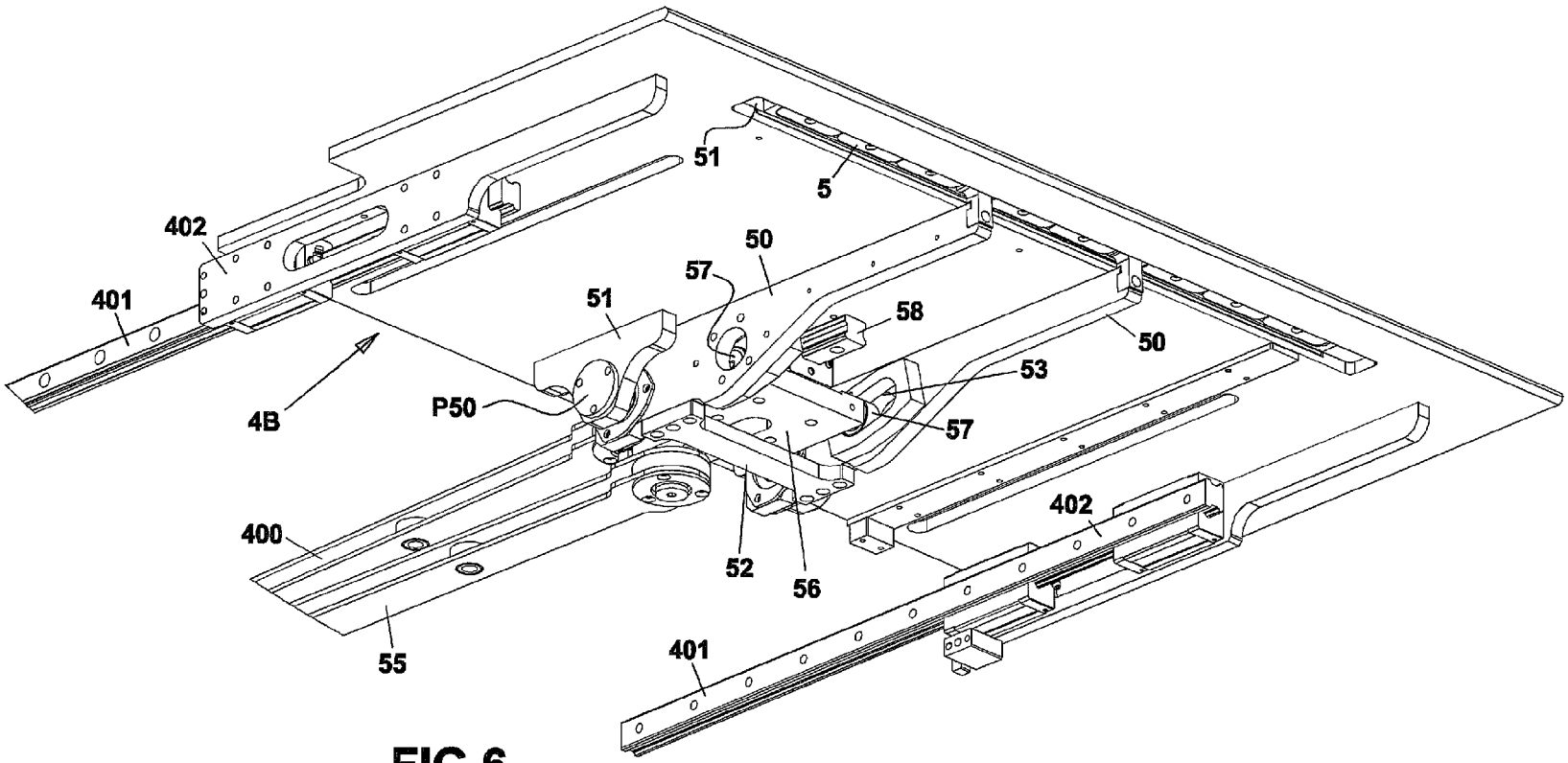
FIG. 6 shows the counter-folder (4B) with the welding bar (5) and the respective driving group.

In accordance with the present invention, the aforesaid means for heating the packaging sheet for welding the edges of the sheet under the rolls comprise an electrical welding bar (5) arranged on a support located below the counter-folder (4B). Said bar (5) is enslaved to a mechanism that controls its exit through an opening (51) provided on the counter-folder (4B), and respectively the return below the latter. These movements of the bar (5) are synchronized with the movements of the counter-folder (4B). With reference to the example shown in FIGS. 5 and 6 of the attached drawings, the welding bar (5) is mounted on two arms (50) located under the counter-folder (4B) and constrained to the latter so as to be able to rotate around an axis parallel to the welding bar (5) extending transversely to the direction of movement of the packages (RM). In the example, the arms (50) are oriented parallel to the direction of movement of the packages (RM) and are constrained to two brackets (51) arranged on the lower surface of the counter-folder (4B) by means of corresponding pins (P50) oriented transversely to the direction of movement of the packages (RM). The arms (50) are joined with each other by a connecting plate (52). Furthermore, each arm (50) has an oblique slot (53), that is inclined so as to exhibit the higher end towards the welding bar (5). The movement of the counter-folder (4B) to and from the folder (4A) is carried out by means of a connecting rod (400) which is solid to the lower surface of the counter-folder and is enslaved to a corresponding actuator (not visible in the drawings). The same movement affects the arms (50), and therefore the welding bar (5), since said arms are constrained to the counter-folder (4B) by means of the brackets (51). Another connecting rod (55) positioned under the counter-folder (4B), by means of a further actuator (not visible in the drawings), is connected to a carriage (56) equipped with lateral rollers (57) inserted in the slots (53). The carriage (56) slides on a rectilinear guide (58) arranged centrally on the lower side of the counter-folder (4B) and oriented parallel to the direction of movement of the packages (RM). The actuation of the connecting rod (400) determines the movement of the counter-folder (4B) and of the group comprising the arms (50) and the welding bar (5) parallel to the direction of movement of the packs (RM). The actuation of the connecting rod (55), which is independent, determines the movement of the carriage (56) along the guide (58) and, consequently, the sliding of the rollers (57) in the slots (53) which entails the rotation of the arms (50) around the axis (W) of the pins (P50). This rotation, which is clockwise or counterclockwise depending on whether the carriage (57) is moved forward (towards the front side of the counter-folder) or backwards, causes the welding bar (5) to be raised with its exit through the opening (51) and, vice versa, its lowering. FIG. 5 and FIG. 6 also show two guides (401) oriented according to the direction of movement of the packages (RM) on which two corresponding rails (402) formed on the lower side of the counter-folder (4B) slide. As illustrated in the attached drawings, the opening (51) through which the sealing bar (5) moves is formed at a predetermined distance from the free edge of the counter-folder. Advantageously, the movement of the bar (5) is controlled in such a way that it comes into contact with the lower side of the packaging sheet (the side resulting under the rolls due to the previously described folding phase) already in the entrance station (E) of the operating group (PG). Therefore, the contact of the welding bar with the packaging sheet is prolonged and it is possible to reduce the operating temperature of the bar itself as well as, possibly, the pressure that the welding bar exerts on the package during the sealing of the lower edge of the packaging sheet. With reference to the example shown in the attached drawings, the aforementioned opening (51) is parallel to the front edge of the counter-folder (4B), that is, orthogonal to the aforementioned direction of movement of the packages (RM).

Figure 7B:
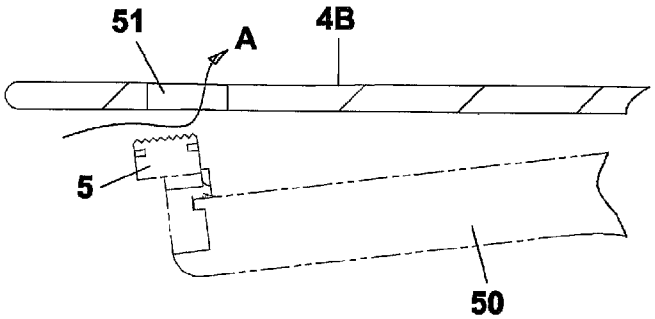
FIG. 7B is a scheme showing the welding bar in the lowered position below the counter-folder (FIG. 7B).
Figure 7A:
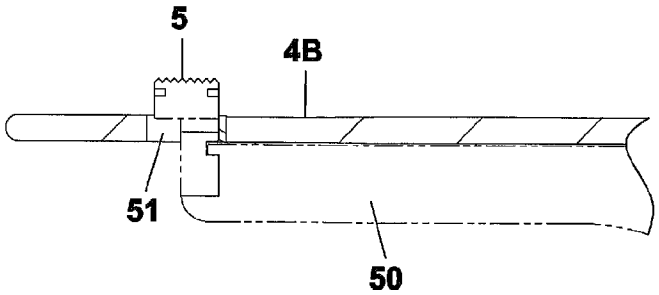
FIGS. 7A is a scheme showing the welding bar in the raised welding position.

Since the welding bar (5) is positioned below the counter-folder (4B) when it is not in the raised welding position, air can flow through the opening (51), removing heat from the products being processed, which contributes to increase the operational safety and reliability of the packaging system. In other words, since the welding bar (5) is positioned below the counter-folder (4B) when it is not in the welding position, sufficient open space is created to allow air (A) to flow freely through the opening (51) since this opening is not obstructed by the welding bar. Therefore, when the welding bar (5) is below the counter-folder (4B), if there is a block or stop of the machine the risk that the film or the paper of the rolls present on the counter-folder may be subject to burning burn due to the temperature of the welding bar (5) is reduced. In the diagram of FIG. 7B the rolls and film lying on the counter-folder are not represented to better highlight the path of the air (A) that flows through the space left free by the welding bar. Furthermore, when the welding bar (5) is below the counter-folder (4B), the risk that the welding bar itself may interfere with the film used to make the packages is drastically reduced. In addition, there is the fact that the relatively high stroke of the welding bar (5) in the passage from the raised welding position to the lower position below the counter-bender and vice versa allows the pressure exerted on the film in the welding phase carried out by the welding bar to be regulated more easily and with greater precision. The air (A) can be compressed air delivered through a suitable duct (not visible in the drawings) in the event of machine stop to counteract the heat flow that goes upwards from the welding bar.

In practice, the details of execution can in any case vary in an equivalent way as regards the individual elements described and illustrated, without thereby departing from the idea of the solution adopted and therefore remaining within the limits of the protection conferred by this patent in accordance with the following claims.

The invention claimed is:

1. Packaging machine for packaging paper rolls, comprising:

an operating group configured to obtain a formation of packages, with an entry station for an entrance of rolls to be packaged and of packaging sheets used for packaging, and a station for an exit of packaged rolls;

an elevator arranged below said entry station;

a metal structure on which said operating group is mounted, in which a plane is arranged on which a folder and a counter-folder are formed at said entrance station to fold the packaging sheets below the rolls of each package;

wherein a conveyor is arranged for handling the packages being formed above said plane along a corresponding movement direction, and in which welding means are arranged for welding the packaging sheets after their folding;

wherein on the counter-folder is mounted a welding bar able to perform the welding of a packaging sheet below the rolls forming each package, said welding bar being supported by a body interlocked with a mechanism which controls an exit of said welding bar through an opening made on the counter-folder and, respectively, a return of said welding bar below the counter-folder, leaving an open space allowing air to pass through said opening when the welding bar is below the counter-folder; and wherein said conveyor comprises a plurality of independent carriages, each of which is formed by a plate, is moved along an annular path which always has a section above the said plane, and on which is applied a row of teeth projecting from the plate, the carriages being controlled such that, during the formation of the packages, three carriages which follow one another along said movement direction form two adjacent compartments in which the rolls and the respective packing sheets are received, with a compartment upstream and another compartment downstream in relation to the movement direction, with a rear carriage, an intermediate carriage and a front carriage, in which the intermediate carriage forms a front side of the compartment located upstream and at a same time forms a back side of the compartment located downstream.

2. The machine according to claim 1, wherein said welding bar is activated in correspondence of said entry station of the operating group.

3. The machine according to claim 1, wherein the plate of each carriage is mounted on two annular tracks oriented orthogonally to said plane and spaced apart from each other by a predetermined value.

4. The machine according to claim 1, wherein said body is formed by two arms arranged on a lower side of the counter-folder.

5. The machine according to claim 1, wherein the mechanism which controls the movement of said body determines the rotation of said body around an axis of rotation oriented transversely to said movement direction.

6. The machine according to claim 5, wherein said axis of rotation is below the counter-folder.

* * * * *